US008635959B1

(12) United States Patent
Silknitter

(10) Patent No.: US 8,635,959 B1
(45) Date of Patent: Jan. 28, 2014

(54) TRAY SYSTEM AND METHOD

(76) Inventor: Scott P. Silknitter, Greensboro, NC (US)

( * ) Notice: Subject to any disclaimer, the term of this patent is extended or adjusted under 35 U.S.C. 154(b) by 388 days.

(21) Appl. No.: 12/898,764

(22) Filed: Oct. 6, 2010

(51) Int. Cl.
*A47B 23/00* (2006.01)
*A47B 13/00* (2006.01)

(52) U.S. Cl.
USPC ..... 108/43; 108/159.12

(58) Field of Classification Search
USPC ..... 108/90, 32–36, 38, 42, 43, 49, 115, 14, 108/12, 11, 157.1–159.12; 248/444, 463
See application file for complete search history.

(56) References Cited

U.S. PATENT DOCUMENTS

| | | | | | |
|---|---|---|---|---|---|
| 469,842 | A * | 3/1892 | Thompson | 312/210.5 |
| 2,683,639 | A * | 7/1954 | Brenny | 108/132 |
| D202,250 | S * | 9/1965 | Hauser | D3/274 |
| 4,052,944 | A * | 10/1977 | Jennings | 108/43 |
| 4,235,472 | A * | 11/1980 | Sparks et al. | 297/392 |
| 4,312,507 | A * | 1/1982 | Smith et al. | 273/237 |
| 4,700,634 | A * | 10/1987 | Mills et al. | 108/43 |
| 5,893,540 | A * | 4/1999 | Scott | 248/118 |
| 5,979,337 | A * | 11/1999 | Clark et al. | 108/43 |
| 6,041,715 | A * | 3/2000 | Jarke et al. | 108/43 |
| 6,745,702 | B2 * | 6/2004 | Goldberg et al. | 108/26 |
| 2005/0211138 | A1 * | 9/2005 | Gupta | 108/43 |
| 2006/0201397 | A1 * | 9/2006 | Sackman | 108/38 |
| 2007/0001359 | A1 * | 1/2007 | Pearl et al. | 269/289 R |

* cited by examiner

*Primary Examiner* — Darnell Jayne
*Assistant Examiner* — Timothy M Ayres
(74) *Attorney, Agent, or Firm* — Blake P. Hurt

(57) ABSTRACT

A modular activity tray system is provided for elderly, infirmed and other users. The tray system consists in one embodiment of a cushioned base which is releasably fastened to a tray on which a variety of board tops can be easily affixed. In another embodiment the tray system includes a leg base having pairs of pivotal legs for containing the tray. In the method of use a variety of board tops can be interchangeably positioned on the tray and releasably affixed thereto for entertainment, crafts, hobby work, eating or other uses.

17 Claims, 4 Drawing Sheets

TRAY SYSTEM AND METHOD

FIELD OF THE INVENTION

The invention herein pertains to a tray system and particular pertains to a modular activity tray system which includes a personal tray and a variety of interchangeable board tops which can be used in a home or group setting by sick or elderly patients, game board players and others for maintaining various items in a convenient, accessible manner.

DESCRIPTION OF THE PRIOR ART AND OBJECTIVES OF THE INVENTION

Personal trays and tray systems have become increasingly popular in recent years, with growing numbers of retired and disabled persons having active but somewhat subdued lifestyles as the activities in which they are able to participate becomes extremely limited. Many conventional T.V. trays are lightweight, flimsy and tend to collapse or fall while in use due to inadvertent contact. Other trays which can be placed on a user's lap have a relatively flat, rigid bottom and can be difficult to hold in a steady manner. Standard trays usually do not have adequate storage space for board games, puzzle pieces and the like. Other trays which are currently available serve only a single purpose and can not be converted and used for more than one activity.

Thus with the disadvantages and inefficiencies of tray systems currently available, the present invention was conceived and one of its objectives is to provide a tray system which includes, in one embodiment a cushion base for ease, stability and comfort while on the user's lap.

It is another objective of the present invention to provide an alternate embodiment of a tray system which includes legs of a suitable length to stabilize the tray for use in a free standing manner.

It is still another objective of the present invention to provide a tray system having a variety of different interchangeable board tops for attachment to the top of the tray by mechanical fasteners, hook and loop material or adhesives and the like.

It is yet another objective of the present invention to provide a tray system and method of use in which the tray includes handles for ease and convenience in manual movement and transportation.

It is still yet another objective of the present invention to provide a tray system for fun and entertainment which will allow the mind and hands of the user to exercise while improving quality of life.

It is a further objective of the present invention to provide a tray system in which the board tops can be easily removed or exchanged depending on the selected activity of the user.

It is still a further objective of the present invention to provide a tray system which is lightweight yet stable while in use such as for crafts, games, puzzles, therapy, dining and the like.

It is yet a further objective of the present invention to provide a tray system which is relatively inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing a modular activity tray system having, in the preferred embodiment a cushioned base for releasably engaging a rectangular tray while used on a lap. In the method of use a variety of interchangeable board tops can be placed on the tray and releasably fastened thereto for individual or group use to enjoy multiple activities such as working on a puzzle or craft, playing a game or practicing dexterity to exercise the senses. The tray includes openings which act as handles for ease in transport and handling and allows for placement of items therein. The board tops may include a board top for dining, one for playing, one for crafts or jigsaw puzzle assembly or any of a variety of other activities for enjoyment purposes.

In another embodiment of the invention the tray is affixed to a leg base having a plurality of legs pivotally joined thereto to allow the tray system to be free standing. The tray system can be used for eating and many other activities by elderly, infirmed and other persons due to its light weight and multifunctional table top features.

DETAILED DESCRIPTION OF THE PREFERRED EMBODIMENT AND OPERATION OF THE INVENTION

Figure 1:
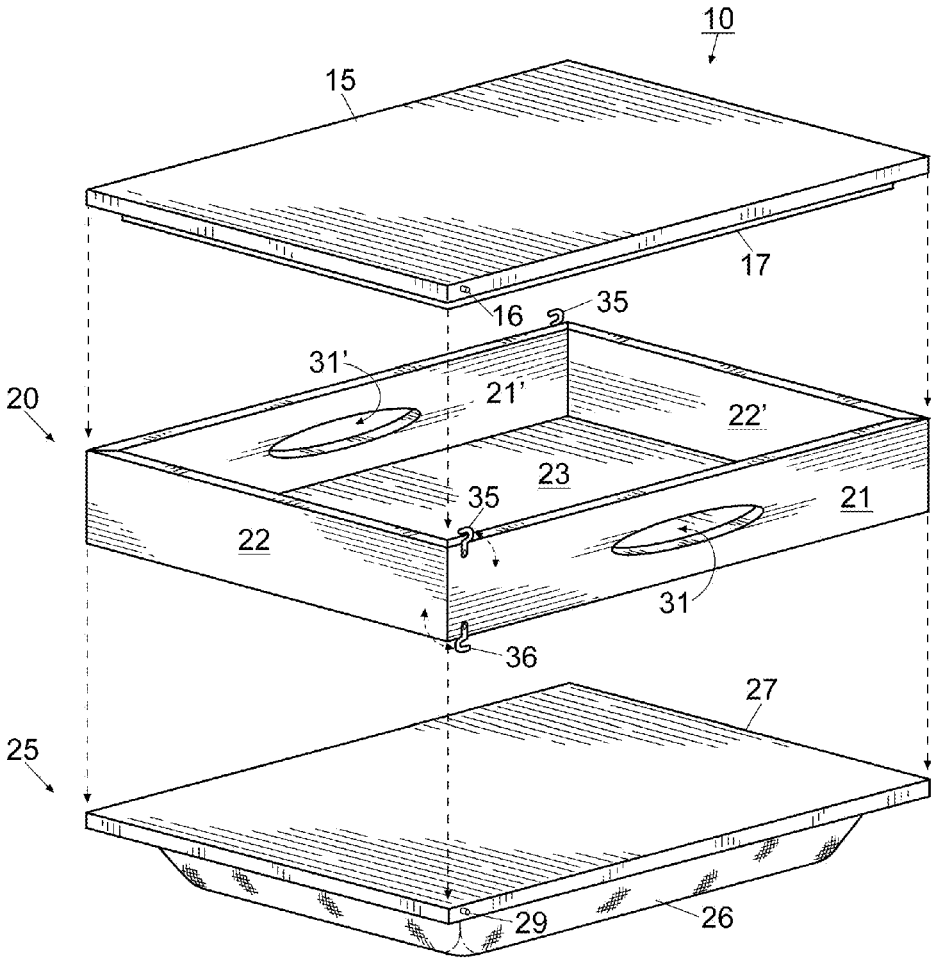
FIG. 1 shows an exploded version of a tray system of the invention.
Figure 2:
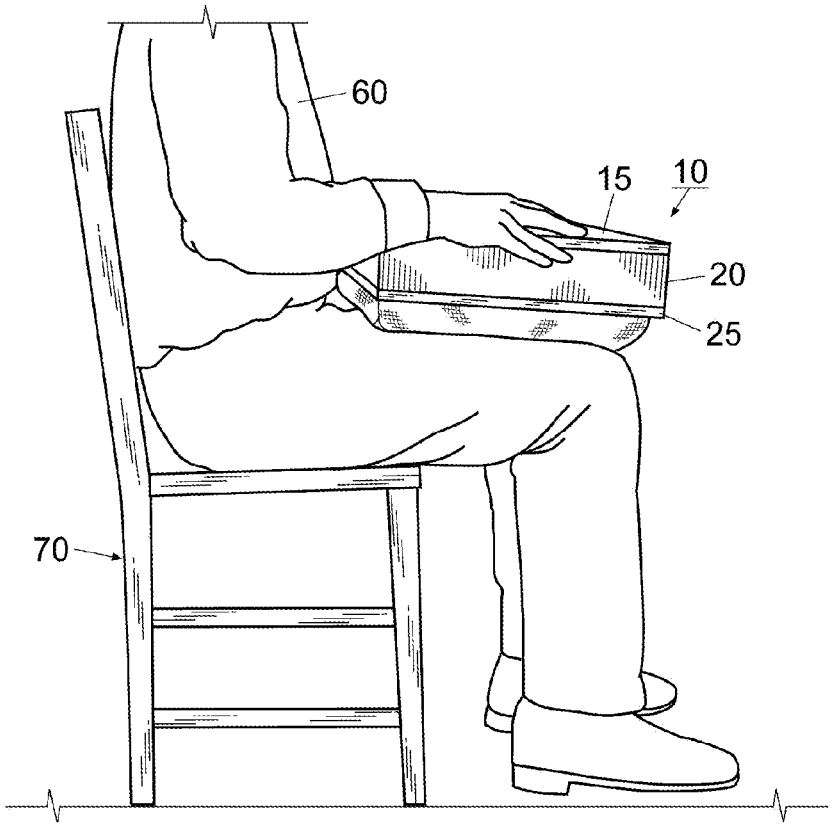
FIG. 2 depicts the tray system of FIG. 1 assembled and positioned on a user's lap.
Figure 3:
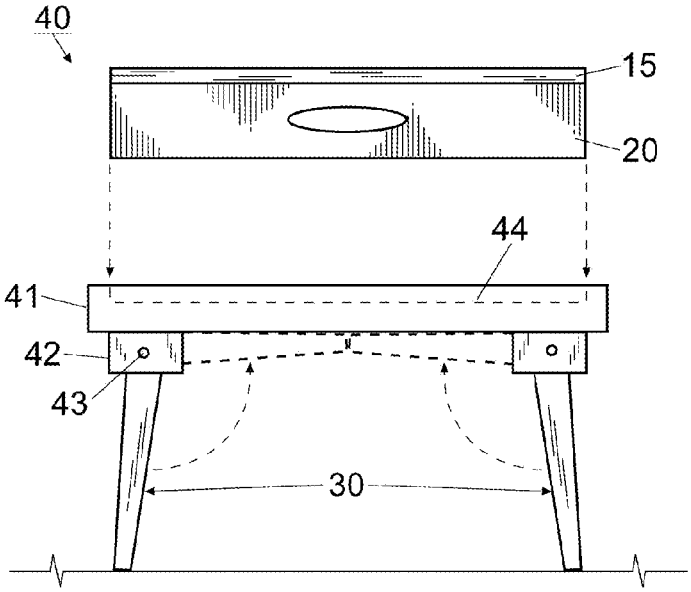
FIG. 3 demonstrates another embodiment of the tray system in a free standing configuration.

For a better understanding of the invention and its method of use, turning now to the drawings, FIG. 1 illustrates preferred tray system 10 in an exploded view with board top 15, tray 20 and cushioned base 25. In FIG. 2, tray system 10 is shown fully assembled and positioned on the lap of user 60 sitting in chair 70 as schematically illustrated. When tray system 10 is fully assembled all outer edges of board top 15, tray 20 and cushioned base 25 are aligned in a uniform, flush fashion. While tray system 10 shown in FIGS. 1 and 2 is formed in three (3) parts for assembly, alternate tray system 40 schematically shown in FIG. 3 provides a free standing tray system in which board top 15 is releasably affixed to tray 20 which in turn is positioned in and frictionally engages leg base 41. Leg base 41 is sized having slightly larger dimensions then tray 20 and includes recessed cavity 44 for receiving tray 20. Leg base 41 includes four (4) legs 30 (only two (2) shown) pivotally attached by four (4) pivot brackets 42 (two (2) shown) in place of cushioned base 25. Pivot brackets 42 allow legs 30 to fold around pivot pins 43 as shown in dotted lines beneath leg base 41 when legs 30 are not needed for storage or other purposes. As would be understood legs 30 could be longer or shorter depending on the desired height of leg base 41. Further leg base 41 could be utilized with or without tray 20 therein providing additional table space as recessed cavity 44 could provide for placement of various craft, hobby or other items.

Board top 15 shown in FIGS. 1 and 2 is relatively flat and planar and may contain perimeter groove 17 underneath around the circumferential outer edge for frictionally engaging the top edges of tray sides 21, 21' and tray ends 22, 22' as shown in FIG. 1 to assist in placement and to prevent board top 15 sliding from tray 20. Groove 17 may be approximately one eighth of an inch (3.175 mm) deep and have a width slightly larger than the thickness of sides 21, 21' and ends 22, 22' of tray 20 for ease in placement. Board top 15 is rectangularly shaped and preferably has a length of approximately fifteen inches (38.1 cm), a width of approximately twelve inches (30.48 cm) and a thickness of approximately one half inch (1.27 cm) and is formed from standard MDF (medium density fiberboard) although woods, plastics, metal and the like may also be utilized.

Tray 20 is rectangularly shaped and preferably has a length of approximately fifteen inches (38.1 cm), a width of approximately twelve inches (30.48 cm) and a depth of approximately three inches (7.62 cm) for maintaining items (not shown) therein. Tray 20 includes bottom 23, opposing sides 21, 21' having respective openings 31, 31' formed therein which act as handles and opposing ends 22, 22', joined together by nails, screws or adhesives (not shown) as is standard. Openings 31, 31' are of an elongated oval shape, however other shapes could likewise be formed in either the sides or ends or tray 20 could be formed without openings. Various types of standard handles may also be used if desired. The thickness of sides 21, 21' and ends 22, 22' are identical, approximately one half inch (1.27 cm) while bottom 23 is approximately one quarter inch (0.635 cm) thick. Tray 20 is likewise preferably formed from MDF (medium density fiberboard) although other materials such as wood, plastic, metal and the like may also be utilized.

Cushioned base 25 is rectangularly shaped and includes vinyl covered polyurethane cushion 26 and rectangular frame member 27. Cushion 26 provides comfort for user 60 when in use and stability as it somewhat conforms to the lap of user 60 to assist in preventing inadvertent sliding. Frame member 27 is planar and also preferably formed from MDF however wood, plastic, metal and the like may also be utilized. Frame member 27 is preferably one half inch thick (12.7 mm) has a length of approximately fifteen inches (38.1 cm), a width of approximately twelve inches (30.48 cm) and is attached such as by adhesives (not seen) or other standard fasteners to cushion 26. Cushion 26 of base 25 may be sized such that base 25 can be positioned overtop tray 20 whereby cushion 26 will fit within tray 20 whereby frame member 27 acts as a lid to form a box with tray 20 for ease in storage and to prevent damage to cushion 26 when not in use. Although not shown frame member 27 may be formed with slightly larger dimensions and include a central recessed cutout sized for frictionally engaging bottom 23 of tray 20 for connection purposes.

For assembly purposes as seen in FIG. 1, dowel pin 29 is affixed to the outer side edge of frame member 27 of base 25 for engagement with rotatable lower metal latch 36 which is affixed to side 21 of tray 20 while upper metal latch 35 likewise affixed to side 21 rotatably engages dowel pin 16 affixed to the outer side edge of board top 15 during assembly. As would be understood a pair of identical upper and lower rotatable latches 35, 36 (only one latch 36 shown) are affixed on the diagonal, outer surface of side 21' of tray 20 for engaging identical dowel pins 16, 29 (only one each of dowel pins 16, 29 shown) positioned on the diagonal, outer side edge surfaces of respectively board top 15 and cushioned base 25. Thus tray 20 includes a plurality of four (4) standard latches 35, 36 which engage respectively two (2) dowel pins 16, one each placed on opposite sides of board top 15 and two (2) dowel pins 29, one each placed on opposite sides of cushioned base 25. Other means for fastening board top 15 and cushioned base 25 to tray 20 are available such as conventional hook and loop fastening materials as shown in FIG. 7, adhesives or any of a variety of other usual fasteners.

Figure 7:
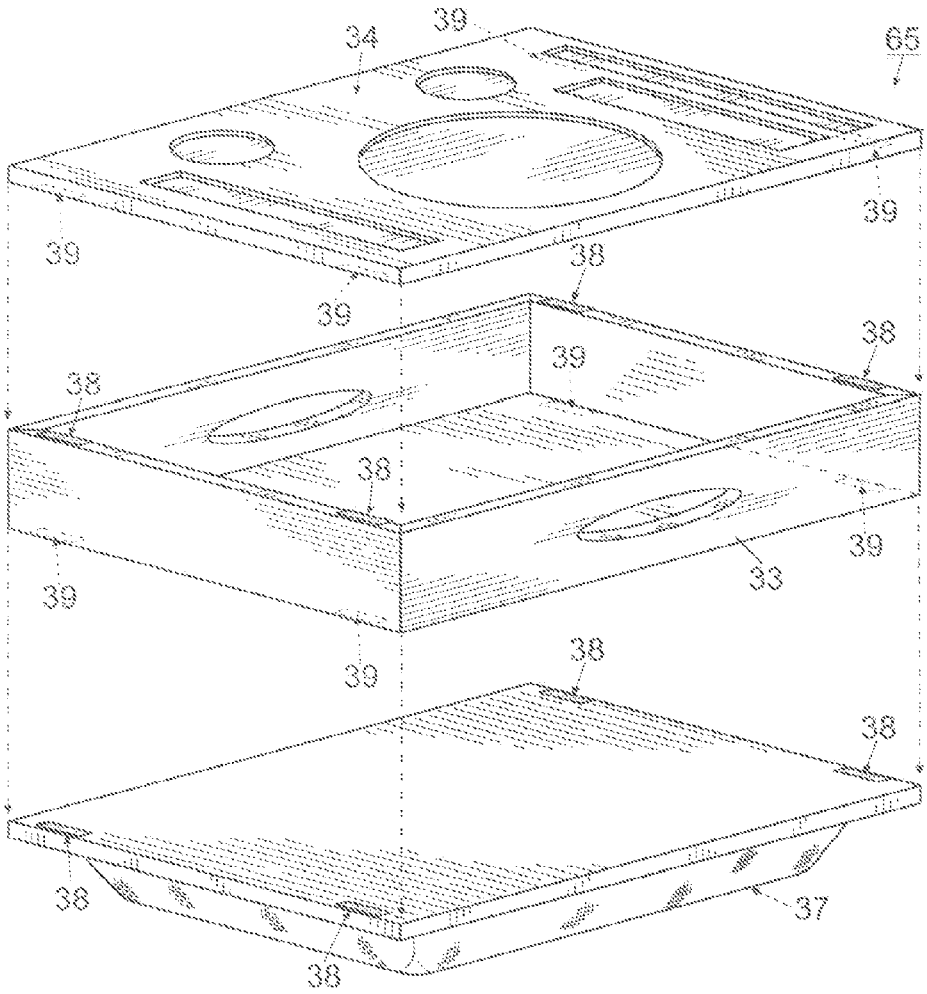
FIG. 7 depicts another embodiment of the tray system utilizing hook and loop fasteners.

FIG. 7 shows alternate tray system 65 which utilizes hook and loop fastening material strips 38, 39 to join board top 34, tray 33 and base 37. Alternate board top 34 includes a series of rectangular loop material strips 39 on the bottom thereof proximate the four (4) corners. Alternate tray 33 includes a series of rectangular hook material strips 38 on the top thereof proximate the four (4) corners in opposing fashion to loop material strips 39 of board top 34 for connection thereto. Tray 33 also includes a series of rectangular loop material strips 39 on the bottom thereof proximate the four (4) corners for connection to alternate base 37 having a series of rectangular hook material strips 38 on the top thereof proximate the four (4) corners. When alternate tray system 65 is in use manual pressure is utilized to either release or join hook and loop fastening material strips 38, 39 for the connection of tray 33 with base 37 and attachment of board top 34 to tray 33, interchanging board tops or disassembly of tray system 65. Fastening means by either latches 35, 36 with respectively dowel pins 16, 29 or hook and loop fastening material strips 38, 39 insures that the tray system will remain joined and intact while in use. Alternate tray system 65 with the removal of base 37 could also be utilized with leg base 41 as desired.

When assembled tray system 10 when in use with board top 15 could be utilized in a user's lap for example for working on a puzzle, holding a book or board game or any of a number of activities. Other alternate board tops for more elaborate functional uses such as board tops 45, 50 or 55 seen in respectively FIGS. 4, 5 and 6 can be interchangeably attached to tray 20 for use as described in more detail below. As would be understood board tops 45, 50, 55 could also be interchangeably attached to tray 20 of alternate free standing tray system 40 shown in FIG. 3 or could be formed having hook and loop fastening material strips 38, 39 for use with alternate tray system 65.

Figure 4:
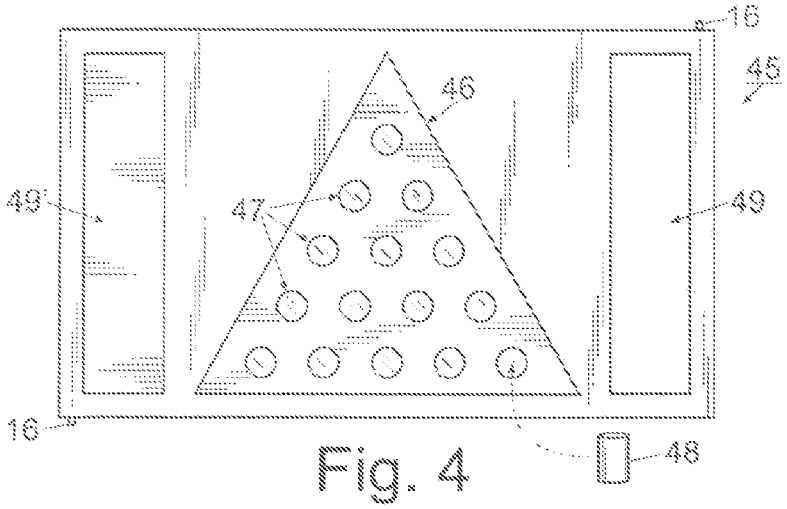
FIG. 4 pictures a top view of a peg game board top with a peg exploded therefrom.

In FIG. 4, containment board top 45 is shown having a routed central triangular cavity 46 with a plurality of recesses 47 for insertion of standard manual pegs 48. Pegs 48 allow one or more persons to play games by placing and moving pegs 48 within recesses 47 under various game rules and conditions enhancing dexterity and hand/eye coordination. Board top 45 further comprises slot 49 which allows the user access to contents within tray 20 therebelow (not shown) and groove 49' for receiving and maintaining pegs 48 therein. Groove 49' and triangular cavity 46 are formed by a standard router and may be approximately one half the depth or about one quarter inch (6.35 mm) of board top 45 which is also preferably formed from MDF and has the same dimensions as board top 15. Board top 45 likewise includes a pair of diagonally opposing dowel pins 16 as hereinbefore described for board top 15 for assembly purposes.

Figure 5:
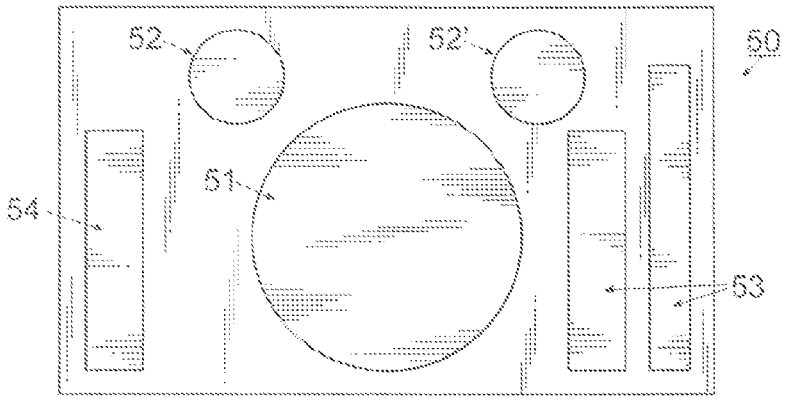
FIG. 5 illustrates a top view of a dining board top.

In FIG. 5 another embodiment board top 50 is shown such as for use at meal time. Board top 50 defines a central circular cavity or recess 51 for placement and stabilization of a standard nine inch dinner plate (not shown) whereas smaller circular recesses 52, 52' will retain conventional juice or water glasses (also not shown). Rectangular recesses 53 allow for placement of a conventional spoon and knife (not shown) whereas rectangular groove 54 allows for placement of a conventional fork (not shown), all items typically used during the meal. Recesses 51, 52, 52', 53 and 54 are formed with a conventional router at a depth of approximately one quarter inch (6.35 mm) of board top 50 and positioned in a conventional table setting assisting users to remember placement of the items and maintaining them in place while in use. Board top 50 is also preferably formed from MDF and has the same outer dimensions as board top 15. Although not shown board top 50 likewise includes a pair of diagonally opposing dowel pins 16 as hereinbefore described for assembly purposes.

Figure 6:
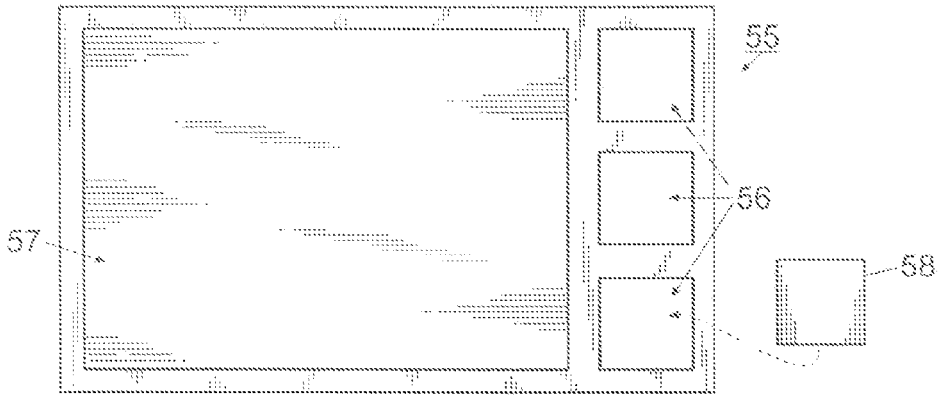
FIG. 6 shows a top view of a puzzle board top.

In yet another embodiment of a board top of tray system 10, board top 55 shown in FIG. 6 includes a series of rectangular apertures or cutouts 56 for example to contain or during extraction of craft parts or the like from tray 20 therebeneath after assembly. A large rectangular groove/routing area or cavity 57 which may be for example one eighth of an inch (3.18 mm) deep allows for jigsaw puzzle parts or the like to be conventionally contained therein. Rectangular apertures or cutouts 56 are sized to receive containers 58 (only one container 58 shown) for holding puzzle pieces, beads, bobbles, buttons or other craft/hobby items (not shown) as desired or may be left empty to allow the user to reach therethrough to access items (not shown) maintained within tray 20. Board top 55 is also preferably formed from MDF and has the same outer dimensions as board top 15. For assembly purposes board top 55 likewise includes a pair of diagonally opposing dowel pins 16 (now shown) as hereinbefore described.

Although not shown, alternate board tops 45, 50 and 55 may also each include a perimeter groove 17 as seen in FIG. 1 on board 15 underneath for frictionally engaging the top edges of tray sides 21, 21' and tray ends 22, 22' to assist in placement and prevent inadvertent sliding of the board tops when positioned on tray 20.

Although only four (4) different board tops are shown herein as would be understood a variety of board tops could be formed having various shapes, cutouts, slots, grooves, cavities, recesses and the like for enjoyment of a variety of activities which may enhance or improve the quality of life whether working on a puzzle or craft, playing a game, or practicing some of life's most basic skills. Further, preferable dimensions are defined herein for the board tops, tray and base which could all be formed having a variety of lengths, widths and thicknesses as well as a different depth of the tray. A conventional bleach cleanable finish may be utilized on all components of tray system 10 or alternate tray systems 40 and 65 for cleaning and sanitizing. Such is beneficial for multiple person use in institutions, hospitals or other care facilities. Alternately, all components of tray systems 10, 40 and 65 can be formed from standard materials which are durable and will tolerate repeated sanitizing cleaning solutions. Many users living with diseases such as Parkinson's, Alzheimers, Dimensia and the like or who have had strokes, head injuries or other traumas which limits their participation are provided with a variety of options by the modular tray system to continue physical as well as mental therapy to exercise the mind, body and senses for improving their quality of life.

In the preferred method of use of tray system 10, a user 60 sits in a chair such as for example chair 70 shown in FIG. 2 and then places cushioned base 25 on his lap. Next, tray 20 is placed atop base 25 and latched by manual rotation of lower latches 36 for engagement with dowel pins 29. Objects, puzzle parts or the like can then be placed in tray 20 as desired and thereafter a board top is selected such as board top 15, 45, 50 or 55 and placed on tray 20 and secured thereto by manual rotation of upper latches 35 for engagement with dowel pins 16. After engagement of latches 35, 36 with respectively dowel pins 16, 29 tray system 10 is assembled, secure and ready for use whereby the particular activity selected is begun. Once the selected activity is concluded, upper latches 35 are disengaged by manual rotation from dowel pins 16 and the selected board top is removed from tray 20 as desired. Jigsaw puzzle parts or the like are then directed from tray 20 and base 25 if desired is disassembled from tray 20 by rotation of lower latches 36 for disengagement from dowel pins 29. Tray 20 once removed from base 25 may be carried by openings 31, 31' and stored along with board tops 15, 45, 50 and 55 and cushioned base 25 as desired. Base 25 can be positioned overtop tray 20 whereby cushion 26 will fit within tray 20 forming a box for ease in storage and to prevent damage to cushion 26 when not in use. Should user 60 desire another activity, tray 20 would remain attached to base 25 and another board top selected and attached to the top of tray 20 by manual rotation of upper latches 35 for engagement with dowel pins 16 of the newly selected board top and the selected activity begun. If desired tray system 10 could remain fully assembled and openings 31, 31' used for lifting and placement of tray system 10 onto another surface as desired by user 60.

The illustrations and examples provided herein are for explanatory purposes and are not intended to limit the scope of the appended claims.

I claim:

1. A tray system comprising: a tray, said tray comprising a bottom, a pair of ends, a pair of sides, said pair of ends and said pair of sides joined to said bottom, each of said pair of ends joined to both of said pair of sides in normal relation thereto, a board top, said board top defining a perimeter groove, said perimeter groove underneath said board top for engaging said sides and said ends, said board top removably affixed to said tray, a leg base, a pivotable leg, said leg foldable beneath said leg base, said leg base defining a cavity, said tray positioned in said cavity, said board top resting on said pair of ends and said pair of sides whereby said board top is flush with said sides and said ends, a fastener, said fastener for connecting said board top to said tray.

2. The tray system of claim 1 wherein said fastener comprises a mechanical fastener.

3. The tray system of claim 1 wherein said fastener comprises a latch.

4. The tray system of claim 1 further comprising a base, said base comprising a bottom cushion, a frame member, said bottom cushion attached to said frame member, said tray releasably mounted to said frame member.

5. The tray system of claim 1 further comprising a dowel pin, said dowel pin attached to said board top, said fastener engaging said dowel pin.

6. The tray system of claim 1 further comprising a pivot bracket, a pivot pin, said leg affixed with said pivot pin to said pivot bracket.

7. The tray system of claim 1 wherein said board top defines a cavity.

8. The tray system of claim 1 wherein said board top defines a slot.

9. The tray system of claim 1 wherein said board top defines a triangular cavity, said triangular cavity defining a plurality of circular recesses, a peg, said peg positioned in one of said plurality of circular recesses, said board top further defining a slot, said slot positioned on said board top beside said triangular cavity, said slot for accessing said tray, said board top also defining a groove, said groove positioned beside said triangular cavity for maintaining said peg therein.

10. The tray system of claim 1 wherein said board top defines a circular cavity.

11. The tray system of claim 1 wherein said board top defines a rectangular cavity and a rectangular aperture, a container, said container positioned in said rectangular aperture.

12. A method of utilizing a tray system comprising the steps of:

a) providing a tray having a bottom surrounded by two sides and two ends, a board top defining a perimeter groove and releasably affixed to the tray, and a leg base with a pivotable leg defining a cavity for receiving the tray;

b) attaching the board top to the tray by placing the ends and the sides into the perimeter groove of said top;

c) stabilizing the tray; and d) manipulating objects on the board top.

13. The method of claim 12 further comprising the step of providing a base, and attaching the tray to the base.

14. The method of claim 13 further comprising the step of placing the base on the lap of a user.

15. The method of claim 12 further comprising the step of removing the board top from the tray.

16. The method of claim 12 wherein attaching the board top comprises the step of attaching the board top to the tray with a mechanical latch.

17. The method of claim 12 wherein attaching the board top comprises the step of attaching the board top to the tray with a hook and loop material.

* * * * *